US005731810A

United States Patent [19]

Oda

[11] Patent Number: 5,731,810

[45] Date of Patent: Mar. 24, 1998

[54] DISPLAY DEVICE WITH CHARACTER MASKING FUNCTION

[75] Inventor: Mamoru Oda, Noda, Japan

[73] Assignee: Sharp Kabushiki Kaisha, Osaka, Japan

[21] Appl. No.: 593,372

[22] Filed: Jan. 29, 1996

[30] Foreign Application Priority Data

May 22, 1995 [JP] Japan ..... 7-122449

[51] Int. Cl.[6] ..... G09G 5/22

[52] U.S. Cl. ..... 345/192; 345/191; 345/195; 345/141; 395/167

[58] Field of Search ..... 395/110, 122, 395/507–509, 805, 167–171; 345/26, 141, 143, 191–195

[56] References Cited

U.S. PATENT DOCUMENTS

| | | | |
|---|---|---|---|
| 5,553,219 | 9/1996 | Kurashige | 395/170 |
| 5,574,842 | 11/1996 | Takakura et al. | 395/805 |
| 5,619,721 | 4/1997 | Maruko | 395/805 |

FOREIGN PATENT DOCUMENTS 5249953 9/1993 Japan .

*Primary Examiner*—Kee M. Tung

[57] ABSTRACT

A character code storage device stores character codes together with display permission information (display levels) attached to every character code. A font data storage device stores font data together with display level values attached to every dot constituting a font. A dot-display-value synthesizer synthesizes these two data and controls dot-display for representing a character according to two kinds of information—display permission information and display level values. The display permission information from a display-permission-value register is reflected at every display level value of dots constituting a font corresponding to the character. When each dot is read from a display circuit, its display level value is also read out and transferred to a display control unit. The transferred dot is compared with a display-permission-level value stored. Dot data which does not meet the condition will not be sent to the display circuit. Consequently, this dot is masked.

9 Claims, 6 Drawing Sheets

CHARACTER CODE MEMORY

| | |
|---|---|
| CHARACTER | ID |
| CHARACTER | ID |
| CHARACTER | ID |
| CHARACTER | ID |
| | |

PERMISSION INFORMATION MEMORY

| | | |
|---|---|---|
| PERMITTED OR NOT | EXCHANGE FONT ID | DISPLAY BIAS |
| PERMITTED OR NOT | EXCHANGE FONT ID | DISPLAY BIAS |
| PERMITTED OR NOT | EXCHANGE FONT ID | DISPLAY BIAS |
| PERMITTED OR NOT | EXCHANGE FONT ID | DISPLAY BIAS |
| | | |

| | | | | | | |
|---|---|---|---|---|---|---|
| 0 | 0 | 0 | 0 | 0 | 0 | 0 |
| 0 | 0 | 0 | 5 | 0 | 0 | 0 |
| 0 | 0 | 3 | 0 | 3 | 0 | 0 |
| 0 | 5 | 0 | 0 | 0 | 5 | 0 |
| 0 | 3 | 3 | 5 | 3 | 3 | 0 |
| 0 | 3 | 0 | 0 | 0 | 3 | 0 |
| 0 | 5 | 0 | 0 | 0 | 5 | 0 |
| 0 | 3 | 0 | 0 | 0 | 3 | 0 |
| 0 | 0 | 0 | 0 | 0 | 0 | 0 |

DISPLAY DEVICE WITH CHARACTER MASKING FUNCTION

BACKGROUND OF THE INVENTION

The present invention relates to a display device having a character masking function and, more particularly, to a display device which is capable of masking a part of a character to be displayed on the display screen. The devised method can considerably improve drawing performance, for example, when it is applied for multi-function remote switching of a display image of a CG drawing device, pocket computer, television and video-recorder.

Conventional display devices are capable of masking dots in a dot pattern uses z-buffer algorithm applied in three-dimensional image display. To generate any three-dimensional image, it is necessary to selectively display the front one of elements overlapping each other. This is realized by using a z-buffer algorithm.

The z-buffer algorithm is embodied with a frame memory storing image data and a buffer, a so-called z-buffer, for storing values of dots in the depth direction, which are separately written therein. The z-buffer can be addressed by two x- and y-axes values like the frame memory.

The z-buffer algorithm is featured in that dot display control is conducted by frequently re-writing dot data to be displayed according to results of comparing the z-axis values (in the depth direction) of the dots having the same coordinate values (x, y). This is a particular algorithm developed for such a three-dimensional graphic processing that a background is first drawn and a foreground element is drawn over the background element (to be painted out by the new element). This method, therefore, causes frequent writing of dot data into the frame memory and the z-buffer, resulting in a decrease of the processing speed of the graphic display. Application of the z-buffer algorithm to a masking character to be displayed may only increase the frequency of accessing the frame memory and z-buffer, resulting in a decrease of processing speed. This masking method is considered to be a method for controlling the writing of data into the frame memory and z-buffer.

While the z-buffer algorithm may be thought to be a dot masking method by controlling writing data into the frame memory and z-buffer, the sprite method may be said to be a dot masking method by controlling reading of data from a frame memory. The sprite method is devised to rapidly move a part of an image on the display screen.

This method uses, besides a frame memory, a plurality of separate "sprite" memories of smaller size, each of which is considered to exist nearer to the observer's eyes than to the frame memory. Furthermore, the display address control unit gives information as to where each sprite memory is located in the frame memory.

When information from the frame memory is displayed on the screen of a display unit, information from the sprite memory is read-out at the same time and sent to the display unit so that it is indicated in an area specified as "sprite area" on the screen image instead of data of the frame memory. Data from the front sprite memory (according to the priority) is sent to the display unit if the plurality of elements read from the sprite memories are overlied one over another. As the result of this, an image of the selected sprite memory can be displayed in the sprite area within an image of the frame memory.

This method, however, replaces dot data read from the frame memory with dot data read from the sprite memory on the basis of coordinate values (x, y) in the frame memory.

The method of replacing dot data in the frame buffer by dot data in another memory can be used for hiding a character string or character strings in a character display device, but it defines the sprite covering area by address in the frame buffer and, therefore, requires a large amount of processing for addressing the sprite area if the location of character strings was changed by scrolling a whole image on the screen, for example.

As described above, a character display wherein the z-buffer algorithm is used may have decreased processing speed because of frequently writing data into frame memory. On the other hand, a character display wherein the sprite method is applied must perform a large amount of processing for generating an address for the driving of a sprite memory if character strings were scrolled and displaced from the initially displayed positions. The above-mentioned methods, which were developed mainly for graphic processing, can not effectively be applied to masking characters because both include many unnecessary operations.

SUMMARY OF THE INVENTION

It is an object of the present invention to improve the processing speed for masking character strings in a character image display by controlling and changing character masking levels according to display permission values.

It is another object of the present invention to provide a display device with a character masking function, comprising a storage for storing character codes with display levels, a storage for storing font data with display level values, a synthesizer for generating dot-display values, a register for storing permissible display values, a display control unit and a display unit, in that a character is displayed according to outputs of the dot-display-value synthesizer and outputs of the display-permission-value register.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

PREFERRED EMBODIMENT OF THE INVENTION

Figure 1:
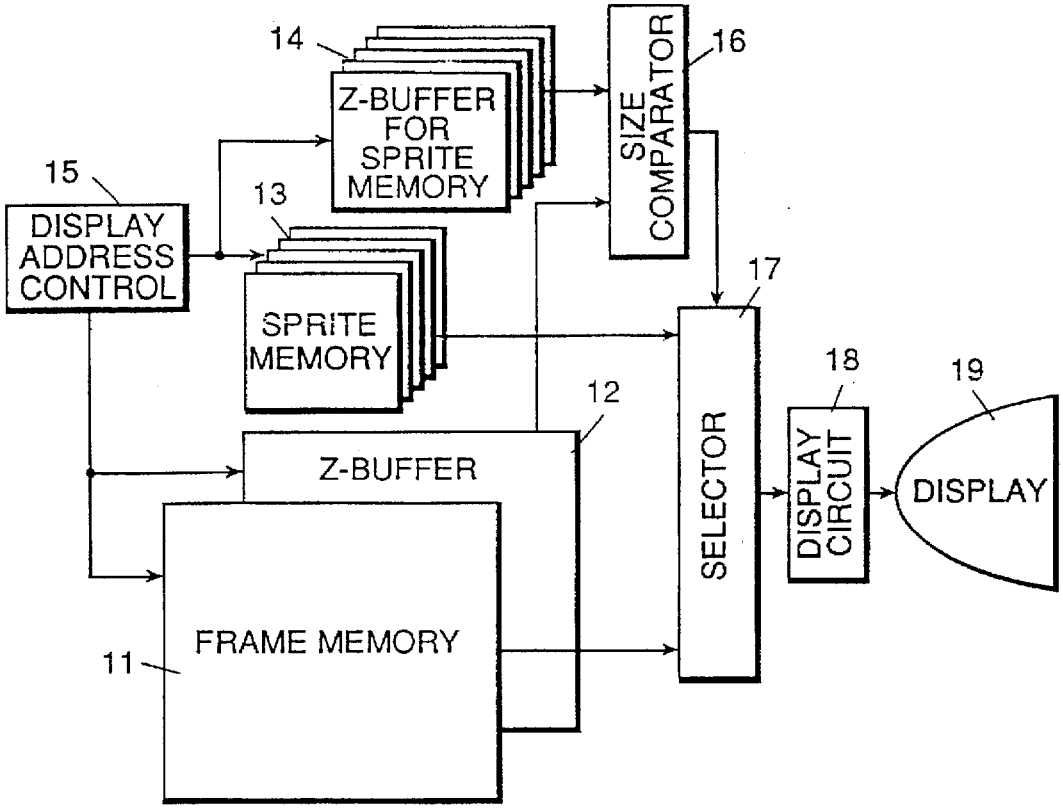
FIG.1 ( PRIOR ART )
FIG. 1 is a view for explaining an example of a conventional z-buffer method and an example of a conventional sprite method.

FIG. 1 is illustrative of an example of an application of the z-buffer algorithm. As shown in FIG. 1, this method is embodied with a frame memory 11 storing image data and a buffer 12, a so-called z-buffer, for storing values of dots in the depth direction, which are separately written therein. The z-buffer 12 can be addressed by two x- and y-axes values like the frame memory 11.

Dot information written in the frame memory 11 has a z-axis value representing its location in the direction of the depth of the image. A dot d0 with c0, z0 is now supposed as written in a location (x0, y0) in the frame memory and a dot d1 (c1, z1) is supposed to be written into the same location (x0, y0) thereof. The z-value of the dot d1 is compared with the z-value of the dot d0. The dot d1 to be written in the frame memory is considered to exist on this side of the dot d0 written therein if z1 is equal to or smaller than z0. The coordinates (x0, y0) in the frame memory are renewed by c1 and the z-value in the z-buffer 12 is also renewed by z1. (A dot having smaller z-value is considered to be nearer to an observer's viewpoint.)

If the z-value z1 of the dot d1 is larger than the z-value z0 of the dot d0, the dot d1 is considered to be beyond the dot d0 and, therefore, it has no need of being put into the frame memory. Consequently, the coordinates (x0, y0) in the frame memory 11 and the z-buffer 12 are left unchanged.

The z-buffer algorithm is featured by dot display control being conducted by frequently re-writing dot data to be displayed according to results of comparing the z-axis values (in the depth direction) of the dots having the same coordinate values (x, y). This is a particular algorithm developed for such a three-dimensional graphic processing that a background is first drawn and a foreground element is drawn over the background element (to be painted out by the new element). This method, therefore, causes frequently writing dot data into the frame memory 11 and the z-buffer 12, resulting in a decrease of the processing speed of the graphic display. Application of the z-buffer algorithm to the masking of a character to be displayed may only increase the frequency of accessing the frame memory and z-buffer, resulting in the decreasing of processing speed. This masking method is considered to be a method for controlling the writing of data into the frame memory and z-buffer.

While the z-buffer algorithm may be thought to be a dot masking method by controlling the writing of data into the frame memory and z-buffer, the sprite method may be said to be a dot masking method by controlling the reading of data from a frame memory. The sprite method is devised to rapidly move a part of an image on the display screen. Referring to FIG. 1, this method uses, besides a frame memory 11, a plurality of separate "sprite" memories of smaller size 13, each of which is considered to exist nearer to the observer's eyes than to the frame memory 11. Furthermore, the display address control unit 15 gives information as to where each sprite memory 13 is located in the frame memory 11.

When information from the frame memory 11 is displayed on the screen of a display unit 19, information from the sprite memory 13 is read-out at the same time and sent to the display unit 13 so that it is indicated in an area specified as "sprite area" on the screen image instead of data of the frame memory 11. Data from the front sprite memory (according to the priority) is sent to the display unit if the plurality of elements read from the sprite memories are overlied one over another. As the result of this, an image of the selected sprite memory 13 can be displayed in the sprite area within an image of the frame memory 11.

In the example shown in FIG. 1, each sprite memory 13 has a sprite z-buffer 14 for applying a z-buffer algorithm thereto. A size comparator 16 compares a z-value of the frame-memory z-buffer 12 with a z-value of the sprite-memory z-buffer 14; a selector 17 writes the sprite memory data into an area within the frame memory 11; a display circuit 18 provides a mask of the sprite memory; and the display unit 19 indicates a processed image.

Figure 2:
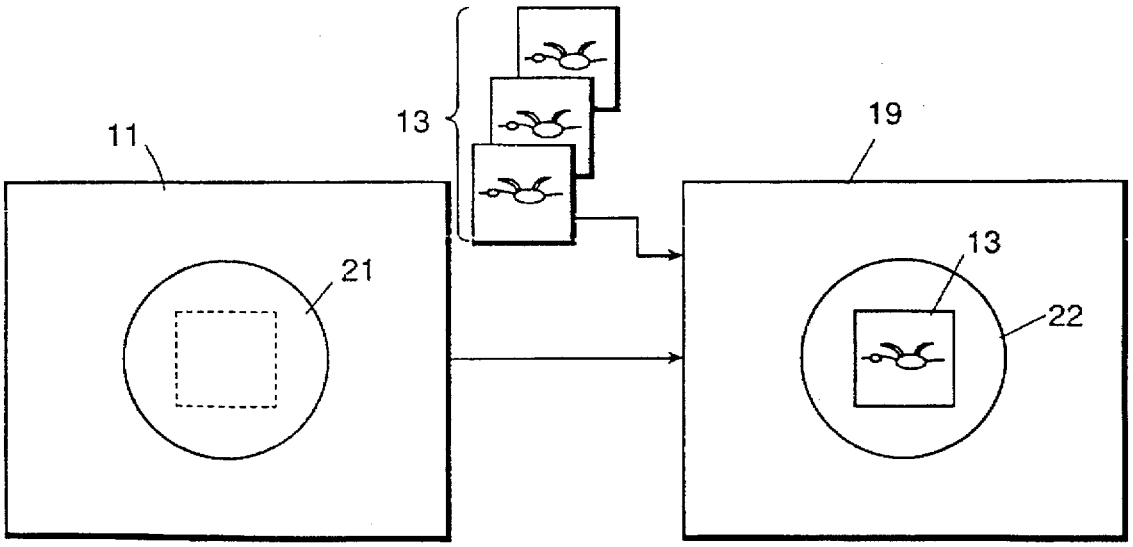
FIG.2 ( PRIOR ART )
FIG. 2 is a view for explaining a display according to the sprite method of FIG. 1.

FIG. 2 is illustrative of an image displayed by using the sprite method. When information is read from a frame memory 11 to be displayed on the screen of a display unit 19, information from a sprite memory 13 is at the same time read-out and sent to the display unit 19 whereby the information from the sprite memory is displayed in a specified "sprite" area 22 on the display screen 19 instead of a corresponding portion 21 of the image read from the frame memory 11. If data read from one sprite memory may overlap another data read from another sprite memory, data from the most front-side sprite memory is selected according to priority and sent to the display unit. As a result of this, the display unit 19 indicates a selected sprite memory image in the area 22 within an image read from the frame memory 12 on its screen.

This method, however, replaces dot data read from the frame memory with dot data read from the sprite memory 13 on the basis of coordinate values (x, y) in the frame memory 11.

The method of replacing dot data in the frame buffer by dot data in another memory can be used for hiding a character string or character strings in a character display device, but it defines the sprite covering area by address in the frame buffer and, therefore, requires a large amount of processing for addressing the sprite area if the location of character strings was changed by scrolling a whole image on the screen.

As described above, a character display wherein the z-buffer is used may have decreased processing speed because of frequently writing data into frame memory. On the other hand, a character display wherein the sprite method applied must perform a large amount of processing for generating an address for driving a sprite memory if character strings were scrolled and displaced from the initially displayed positions. The above-mentioned methods, which were developed mainly for graphic processing, can not effectively be applied to masking characters because both include many unnecessary operations.

In view of the an object of foregoing, the present invention is to improve the speed of processing for masking character strings in a character image display by controlling and changing character masking levels according to display permission values.

The above-mentioned object of the present invention has been realized by controlling display of character dots according to two kinds of information—display permission information attached to each character code and a display permission value attached to each of the dots constituting a character font. The display permission information is reflected in every display level value of each of the dots constituting a corresponding character font. Each dot data read from a display circuit is sent to a display control unit together with its display level value read at the same time. The dot data is compared with a permission level value stored and will not be sent to the display circuit if it could not meet the required condition. In other words, this dot is masked not to be displayed.

On the other hand, any masked dot data can be uncovered only by changing its preset permission value since every dot is read-out together with its display level value. This function makes it possible to effectively display dot data of different display levels on the display screen with no need for frequently writing character data into an image memory as was done in the prior arts.

Figure 3:
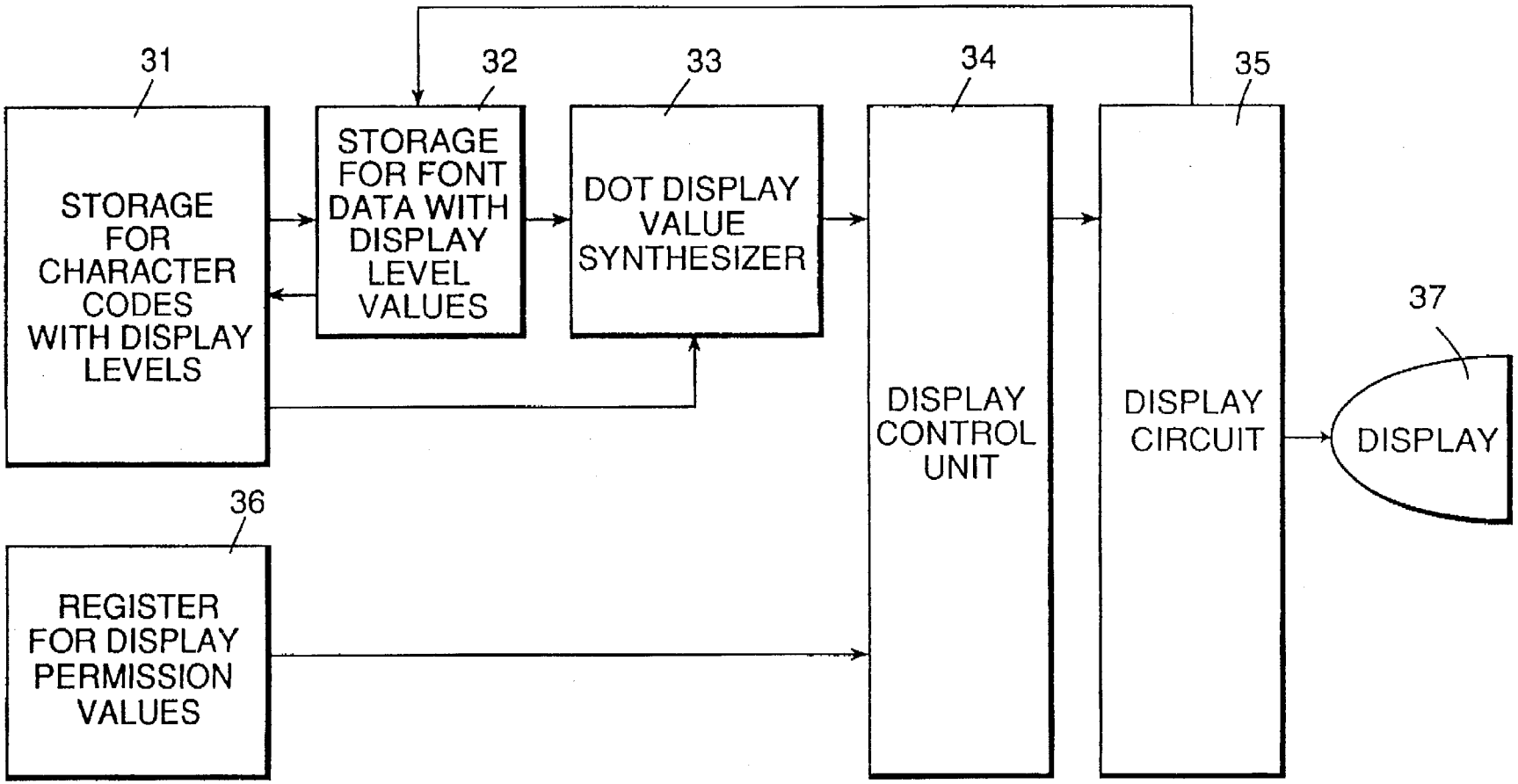
FIG. 3 is a general construction view for explaining a display device embodying the present invention.

FIG. 3 is a basic conceptual view for explaining a display device with a character masking function, which is a preferred embodiment of the present invention. In FIG. 3, the display device comprises a storage device 31 for storing character codes with display levels, a storage device 32 for storing font data with display level values, a synthesizer 33 for generating display dot values, a display control unit 34, display (CRT) circuit portion 35, a register 36 for storing a display permission value and a display (CRT) 37. The storage device 31 stores character code data and information on permission to display character codes.

Figures 4, 5A, 5B:
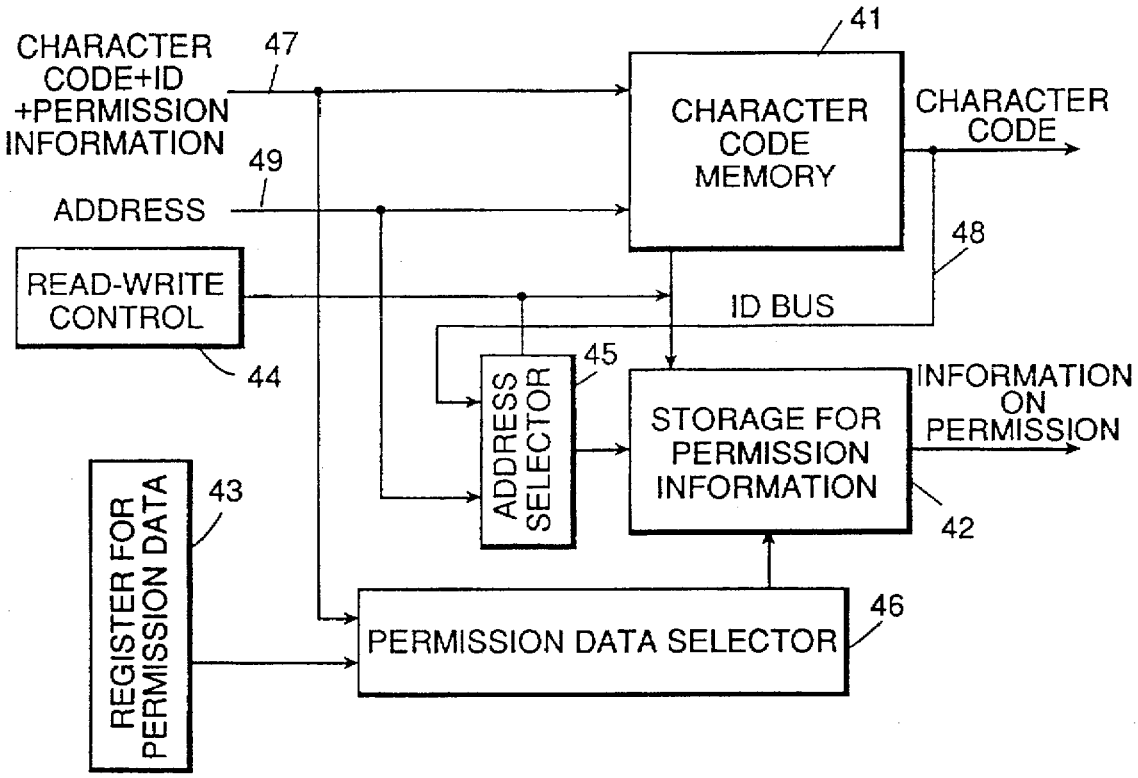
FIG. 4 is a detailed construction view of a storage for storing character codes with display levels, which is indicated in FIG. 3.
FIGS. 5A and 5B are views showing an exemplified character code memory and an exemplified permission information memory.

FIG. 4 is a detailed view of the storage device 31 for storing character codes with display levels, which is shown in FIG. 3. This storage device 31 comprises a character code memory 41 for storing character codes and address data of permission information, a permission information memory 42 for storing permission information, a permission information register 43, read-write control unit 44, an address selector 45 and permission data selector 46. Character codes with IDs (identifiers) and permission information are inputted by an input device (not shown) into the character code memory 41 and the permission information memory 42 through a data bus 47. At this time, the memory address is addressed through an address bus 49.

FIG. 5A shows an exemplified content of the character code memory 41 and FIG. 5B shows an exemplified content of the permission information memory 42. It is possible to separately store character codes and IDs in the character code memory 41 and permission information in the permission information memory 42. The character code memory 41 and the permission information memory 42 generally have the same size but they may be designed to have different sizes since the address selector 45 can find permission information corresponding to a selected character code by referring through the bus 48 to an ID attached to the character code.

When data is read from these memories, the write-read control unit 44 controls the address selector 45 to select an ID data from the character code memory 41 through the ID bus 48 and uses it as an address of the permission information memory 42. The character code and the corresponding permission information are thus read-out and transferred to the post-stage storage device 32 for storing font data with display level values.

Figure 6:
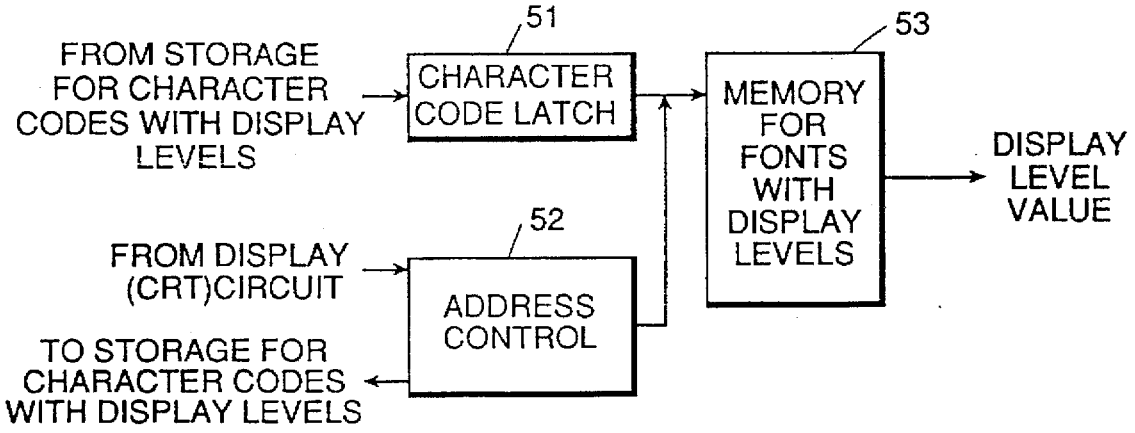
FIG. 6 is a detailed construction view of a storage for storing font data with display levels, which is indicated in FIG. 3.

FIG. 6 is a detailed view of the storage device 32 for storing font data with display level values, which is shown in FIG. 3. This font data storage device 32 comprises a character code latch 51, an address control unit 52 and a font memory 53 for storing font data with display level values. The address control unit 52 receives horizontal and vertical signals from the display (CRT) circuit portion 35, generates an address of an ordinary display unit (CRT) 37 and produces a reading signal for reading the memory 53 for font data with display level values. It also generates a reading address for the font memory 53 synchronously with producing the reading signal. The font memory 53 outputs display level value data. The display level value outputted from the font data storage 32 is transferred to the post-stage dot-display-value synthesizer 33.

Figure 7:
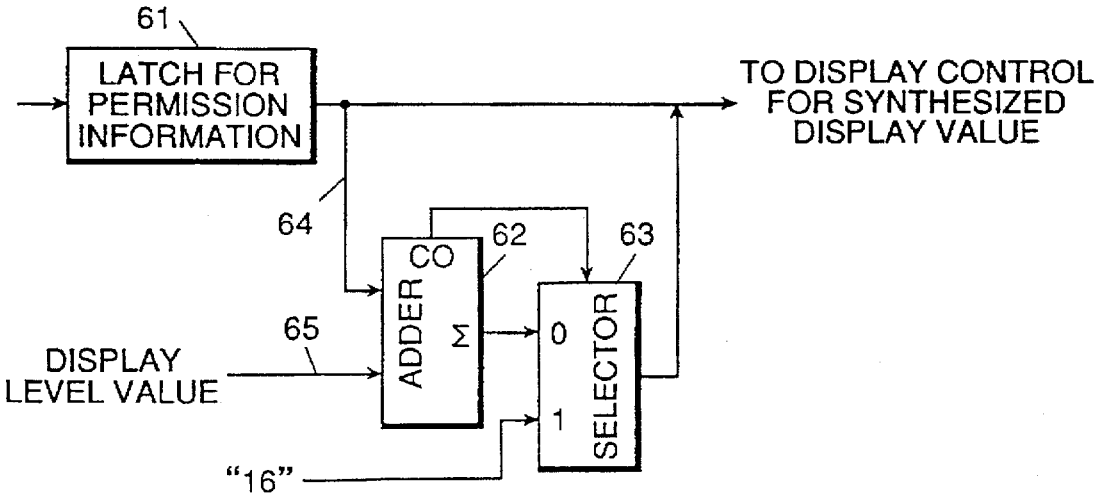
FIG. 7 is a detailed construction view of a synthesizer for generating dot-display values, which is indicated in FIG. 3.

FIG. 7 is a detailed view of the dot-display-value synthesizer 33, which is shown in FIG. 3. This synthesizer 33 mainly comprises a permission information latch 61, an adder 62 and selector 63. The permission information read from the permission information memory 42 (FIG. 4) is stored in the permission information latch 61 and display bias data within the permission information is supplied through a bus 64 to the adder 62. On the other hand, a display level value from the font data storage 32 is transferred through a bus 65 to the adder 62. The display bias data and the display level value are added to each other and the result data is outputted as a synthesized value for display together with code "Permitted" or "Not permitted" and an ID of exchange font. The synthesized output value is used for controlling transferring data to the display circuit 35 by the display control unit 34.

Figure 8:
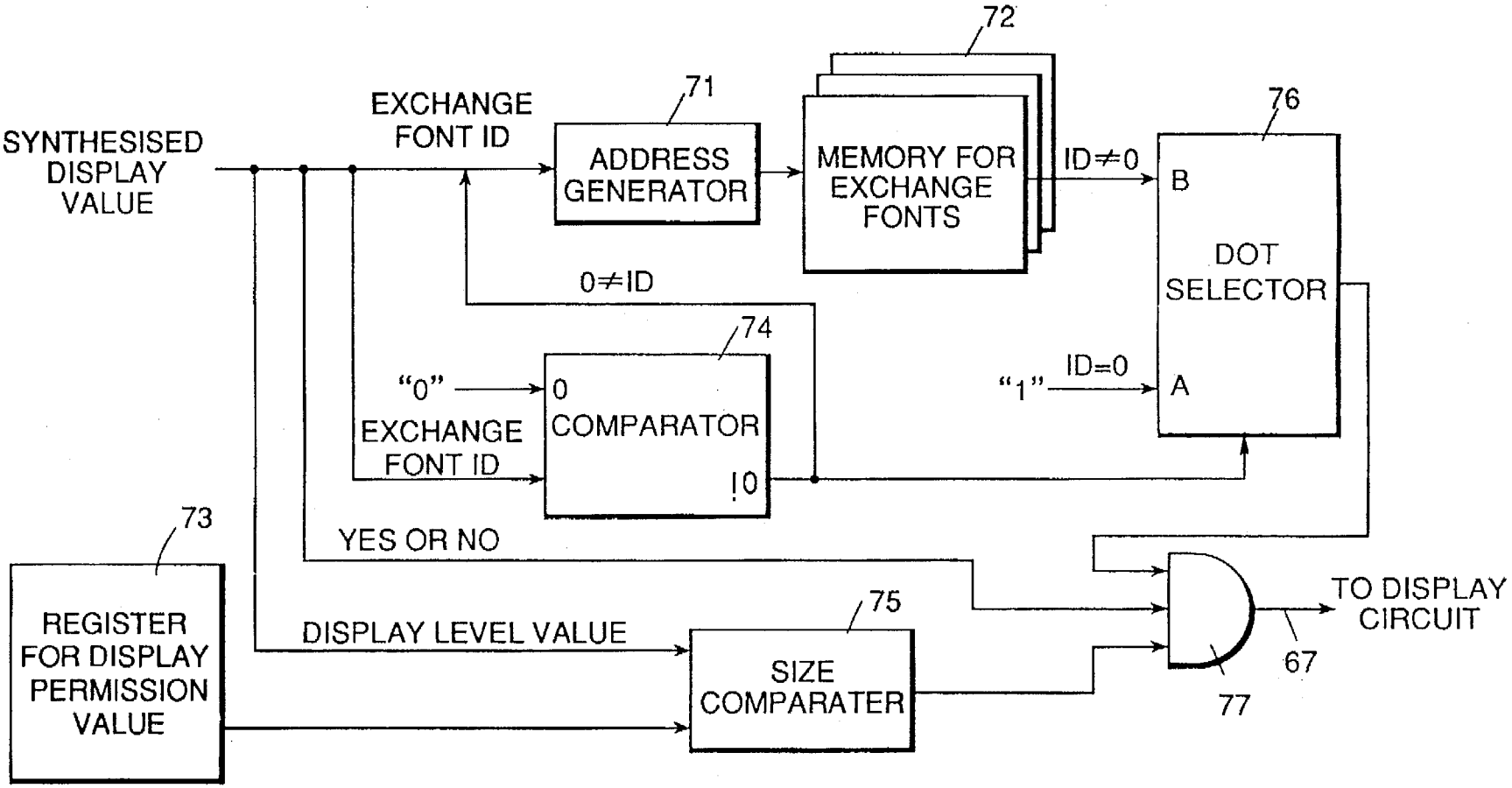
FIG. 8 is a detailed construction view of a display control unit indicated in FIG. 3.

FIG. 8 is a detailed view of the display control unit 34, which is shown in FIG. 3. The display control unit 34 is composed mainly of an address generating portion 71, exchange font memory 72, a display-permission value register 73, a zero comparator 74, a size comparator 75, a dot selector 76 and a permission gate 77. An exchange font ID is transferred to the address generator 71 through which it is given as an address of an exchange font to the exchange font memory 72. The exchange font ID is also transferred to the zero comparator wherein it is used as comparison data. The size comparator 75 compares a display level value with a permissible level value preset at the display permission register 73 and it may have an effective output when the input data has the display level value larger than the permissible level value. The effective output of the size comparator appears as a gate signal at the permission gate 77. When the zero comparator 74 detects the input ID to be zero (indicating an exchange font will not be used), it selects an input A of the dot selector 76 and sends it to the permission gate 77. If the exchange font ID is not zero, it will be first sent to the address generator 71 that in turn generates an address of the exchange font base and increases an offset address thereof by the offset number of synthesized display value to be transferred next. The exchange font memory 72 transfers dot data through an input B of the dot selector 76 to the permission gate 77. The content of the exchange font memory 72 consists of ordinary bits of 0 and 1. Therefore, it will be not described further in detail. The above-mentioned processing enables the display device to represent characters by quite different exchange fonts.

In the above-mentioned embodiment of the present invention, the character code storage device 31 stores character codes, each of which has an attribute value for permission to be displayed, and the font data storage device 32 stores character font data (pixels) with a display level set for each pixel. The pixel data selected by a character code together with its display level value is sent to the display control unit wherein the data is compared with the permission data set at the display permission register and only a suited pixel is transferred to the display unit 37. In addition, the storage device 32 for storing font data with the display level values, can be used in combination with a memory having Z-buffer algorithm, to provide the potential to display or mask character or icon information at a specified area on a screen of the display 37 by changing only the permissible display values.

Figures 9A, 9B:
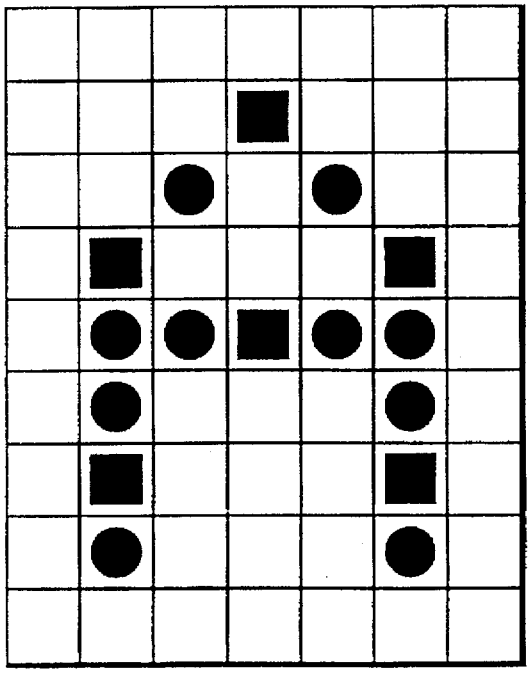
FIGS. 9A and 9B are views showing an example of display level data and an example of a display image based on said data.

FIG. 9A shows an example of display permission value data for each pixel and FIG. 9B shows an example of a character to be formed by pixels having permissible level values. With a permission value of 5, only square fonts (pixels) are displayed and other parts of the character (shown by circular pixels) are masked, thereby the character is roughly represented. With the permission value changed to 3, the square fonts (pixels) and the circular fonts (pixels) are displayed to distinctly represent the character. In other words, a display level attached to each of pixels constituting a font and a display level attached to a character code corresponding to the font are synthesized together and the synthesized value is then compared with a preset permissible display value to select only suited pixels to be displayed. By doing so, any character can be also represented vaguely.

As is apparent from the foregoing, the display device according to the present invention offers the following advantages:

The elements of an image to be displayed can be masked or uncovered by changing their display-level values, eliminating the need for frequently writing display data into an image memory.

Selection of dots (pixels) constituting a font according to their display level values provides the possibility to generate a vague character that a user may suppose.

The provision of every character code with a font exchange ID enables the user to represent a secret character or a string of secret characters by another character or characters or dot data to maintain the secrecy.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A display device with a character masking function, comprising:

a storage device for storing character codes with display levels and for storing font data with display levels;

a synthesizer for generating dot-display values, including display levels, from the stored character codes and font data;

a register for storing permissible display values;

a display control unit for comparing display levels of the dot-display values to the permissible display values and for masking display of dot-displaying values with display levels below the permissible display values; and a display unit for displaying dot-display values in a font corresponding to the stored font data, of display levels greater than or equal to the permissible display values.

2. A display device with a character masking function according to claim 1, wherein the storage device for storing font data with display level values, in combination with a memory having a z-buffer algorithm, provides the potential to display or mask character and icon information at a specified area on a screen of the display unit by changing only the permissible display values.

3. A display device with a character masking function according to claim 1, wherein the storage device stores font data with the display levels and includes a memory for storing dot data composing font and display-level values, provided one for each dot, and wherein dot data and a corresponding display-level are simultaneously read-out with reference to an address readable together with the dot data.

4. A display device with a character masking function according to claim 1, wherein the synthesizer for generating dot-display values performs operations on display permission information read from the storage device for storing character codes with display levels and a display level read from the storage device for storing font data with display levels and transfers the resultant value to the display unit arranged at a post-stage thereof.

5. A display device with a character masking function according to claim 1, wherein the display control unit includes processing device for changing or deleting dot display values by using display permission previously set in the display level storage device and a display level value and generates a permission signal for further transferring the dot display values to the display unit.

6. A method for displaying and masking characters, comprising the steps of:

storing character codes and display levels;

storing font data;

generating dot-display values, including display levels, from the stored character codes and font data;

storing permissible display values;

comparing the display levels of the generated dot-display values and the permissible display values; and masking display of dot-display values below the permissible display values based upon the comparison and displaying other dot-display values.

7. The method of claim 6, further comprising:

varying the stored permissible display values to thereby vary the dot-display values masked and displayed.

8. The method of claim 7, wherein the displayed dot-display values are displayed in a font corresponding to the font data.

9. The method of claim 6, wherein the displayed dot-display values are displayed in a font corresponding to the font data.

* * * * *